US008806828B2

(12) United States Patent
Suthar

(10) Patent No.: US 8,806,828 B2
(45) Date of Patent: Aug. 19, 2014

(54) SYSTEM FOR REPLACING PANELS FROM THE CENTER OF A FINISHED, INTERLOCKED FLOOR

(71) Applicant: Yogin P. Suthar, White Plains, NY (US)

(72) Inventor: Yogin P. Suthar, White Plains, NY (US)

( * ) Notice: Subject to any disclaimer, the term of this patent is extended or adjusted under 35 U.S.C. 154(b) by 0 days.

(21) Appl. No.: 13/729,165

(22) Filed: Dec. 28, 2012

(65) Prior Publication Data

US 2014/0182228 A1 Jul. 3, 2014

(51) Int. Cl.
*E04B 2/00* (2006.01)
*E04G 23/02* (2006.01)
*E04F 13/08* (2006.01)

(52) U.S. Cl.
CPC ..... *E04G 23/0285* (2013.01); *E04F 13/0821* (2013.01)
USPC ..... 52/582.1; 52/586.1

(58) Field of Classification Search
CPC ..... E04F 13/821; E04F 13/826; E04F 15/215
USPC ..... 52/582.1, 586.1, 585.1, 588.1, 589.1
See application file for complete search history.

(56) References Cited

U.S. PATENT DOCUMENTS

| | | | | |
|---|---|---|---|---|
| 6,536,178 | B1 * | 3/2003 | Pålsson et al. | 52/589.1 |
| 6,763,643 | B1 * | 7/2004 | Mårtensson | 52/586.1 |
| 6,769,217 | B2 * | 8/2004 | Nelson | 52/582.1 |
| 7,552,568 | B2 * | 6/2009 | Palsson et al. | 52/589.1 |
| 8,490,360 | B2 * | 7/2013 | Pervan et al. | 52/591.1 |
| 2007/0175143 | A1 * | 8/2007 | Pervan et al. | 52/403.1 |
| 2008/0168736 | A1 * | 7/2008 | Pervan | 52/586.1 |
| 2008/0209837 | A1 * | 9/2008 | Pervan | 52/588.1 |
| 2011/0131916 | A1 * | 6/2011 | Chen et al. | 52/588.1 |

* cited by examiner

*Primary Examiner* — Basil Katcheves

(57) ABSTRACT

The invention is a system based on adaptors and replacement panel design that allows replacement of a panel that is surrounded by other panels in an interlocking floor system. Since the panel to be replaced is surrounded by panels that cannot be disturbed, only vertical motion is available to allow the replacement panel to be positioned into the space. One side of the adaptors of the invention mates to the surrounding panels in a standard manner. The other side of the adaptors provides an interface that allows vertical interlocking of the new replacement panel. The replacement panel of the intervention provides interfaces along its edges that allow vertical mating with the adaptors' vertical interlocking mechanism.

10 Claims, 4 Drawing Sheets

SYSTEM FOR REPLACING PANELS FROM THE CENTER OF A FINISHED, INTERLOCKED FLOOR

BACKGROUND OF THE INVENTION

The present invention is in the field of flooring systems. More particularly, the present invention is in the field of modifying an existing interlocked floor by replacing floor panels from the center of the floor.

Hardwood, manufactured wood, laminate, and new vinyl based flooring systems are very popular today. They all utilize similar interlocking mechanisms to connect floor panels together to create a finished floor. Once installed, it is extremely difficult to replace a panel is the middle of the floor. In order to do so requires unlocking the entire floor up to the panel at issue, replacing the panel, and then reinstalling the area of the floor that was removed. This effort often exceeds the value gained and the process weakens the interlocking structures.

Hence, manufacturers provide patch materials that can be used to fill in small scratches and dents. However, these are often inadequate and only address small damages. Additionally, there is no way to address the issue if the user wants to replace individual floor panels for cosmetic reasons such as to establish a pattern of various colors, textures, or styles.

There is therefore, a need for a system that allows replacement of individual floor panels in an inter-locking floor with minimal effort.

SUMMARY OF THE INVENTION

The difficulty in replacing a panel in the center of an inter-locking flooring system lies primarily in the fact that such floors are installed in a horizontal plane. In other words, the panels are inter-locked using primarily, a horizontal motion. When the floor is initially installed, there is room to advance each panel in the horizontal direction from the area of the floor that is yet unfinished. However, once the floor is completely installed, it is impossible to install a replacement panel as there is no space to negotiate the horizontal motion. For example, when a damaged panel is removed, the opening created is surrounded by other panels. There is only a vertical direction that can be leveraged to install the replacement panel.

Hence, the basic concept being proposed in the current invention is that of converting the requirement for horizontal motion into one of vertical motion. The present invention allows a replacement panel to be installed vertically down into a space in the center of an interlocked floor. This conversion is achieved by use of adaptors and specially designed replacement panels. The adaptors of the invention convert the requirement for horizontal motion into vertical motion. The replacement panel of the invention is specially designed to lock into the adaptors in a vertical direction.

DETAILED DESCRIPTION OF THE PREFERRED EMBODIMENTS

Inter-locking flooring systems leverage slight variations of a basic tongue and groove mechanism to establish a secure mechanical bond between two panels. Each rectangular floor panel has two tongue sides and two groove sides. The edge of each panel must be negotiated into the complementary edge of another. In simple tongue and groove systems such as with traditional hardwood floors, this action requires horizontal motion to bring the mating pieces together. In laminate flooring systems, a slight vertical angle may be required but the primary motion is still horizontal. In all cases, in order to add a panel of flooring to the installation, 2 of the 4 sides must be open in order to provide space for the horizontal motion to take place. This is not a problem daring the initial installation. However, when replacing a floor panel in a finished floor, this process is impossible.

The invention converts the horizontal motion necessary to join two panels into a vertical motion by use of adaptors and specially designed replacement panels. In interlocking flooring systems, there are two types of edges on the floor panels; a groove edge and tongue edge. The groove edge of one panel interlocks with the tongue edge of another. From the perspective of a given existing panel's edge, the adaptors of the invention depicted in FIGS. 2 and 3 behave exactly like the complementary edge of another panel. However, the opposite face of the adaptors present upward facing interlocking structures that vertically accept a complementary structure on the edge of the replacement panel.

The new replacement floor panel is kept secure by gluing along the length of the interfaces between the adaptor and new floor panel along all 4 edges. Alternatively, depending on the materials used, manufacturing tolerances, and usage application, friction may be sufficient to keep the replacement panel secured.

Figure 1:
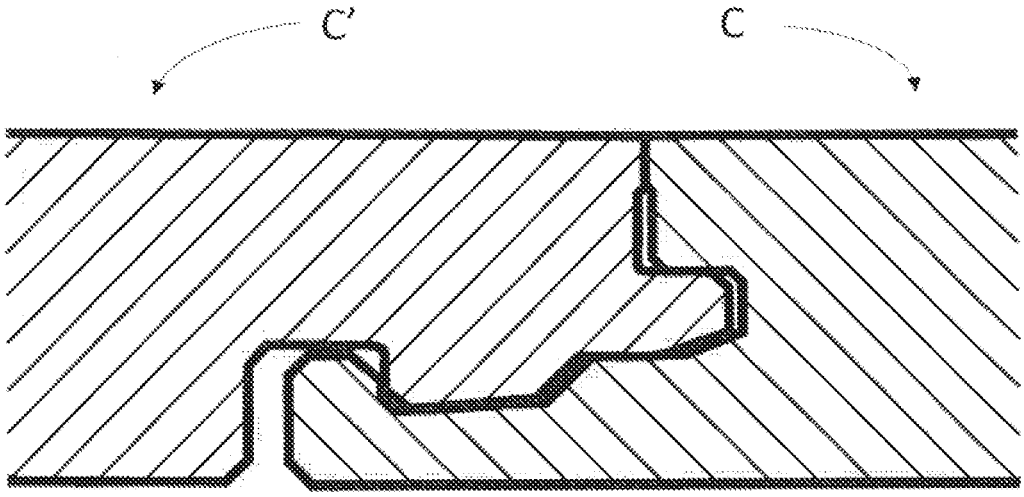
FIG. 1 depicts the side view of a common interlocking joint used in flooring systems today, where C' represents the tongue side and C represents the groove side.
Figure 2:
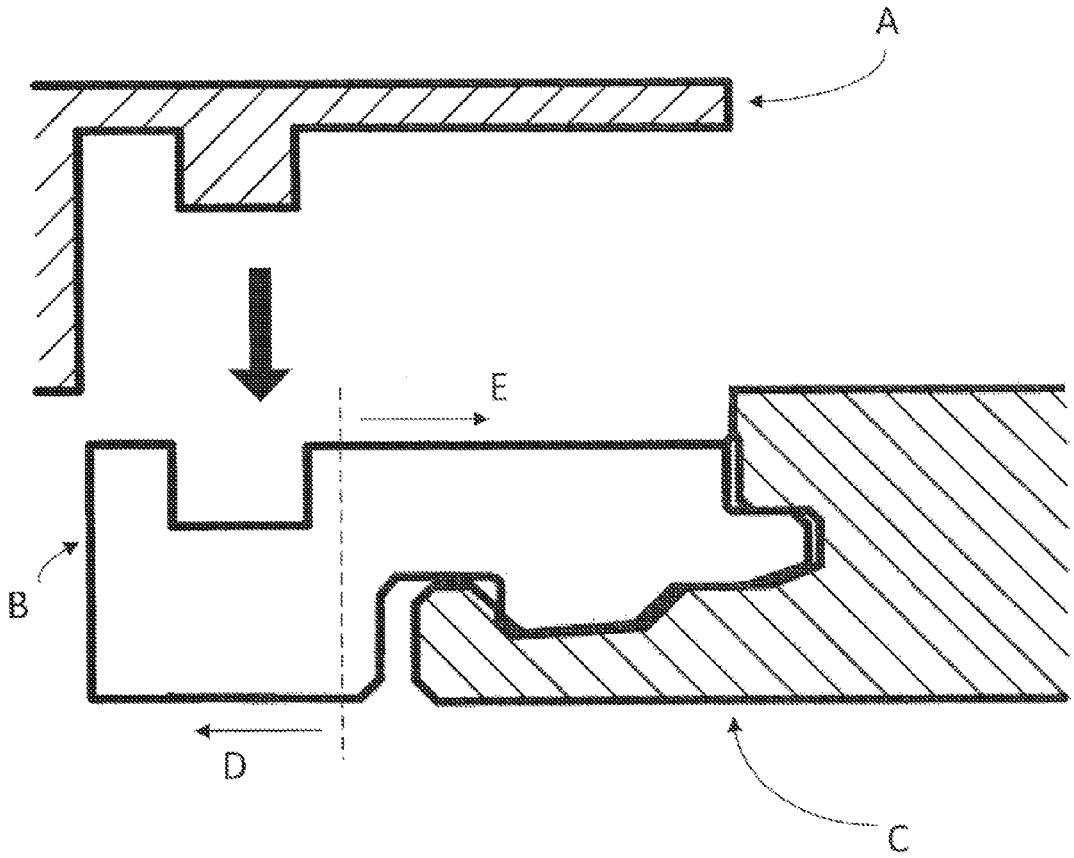
FIG. 2 depicts the invention used on the groove side of the existing flooring. A depicts the new replacement panel of the invention that is to be added with one of its lateral faces designed to interlock vertically with a complementary structure on face D of the adaptor B of the invention. B depicts the adaptor of the invention whose face E connects horizontally to existing flooring panel C and whose face D mates vertically with new flooring panel A. C depicts a panel of the existing floor that presents a grooved face into the space vacated by the panel to be replaced.
Figure 3:
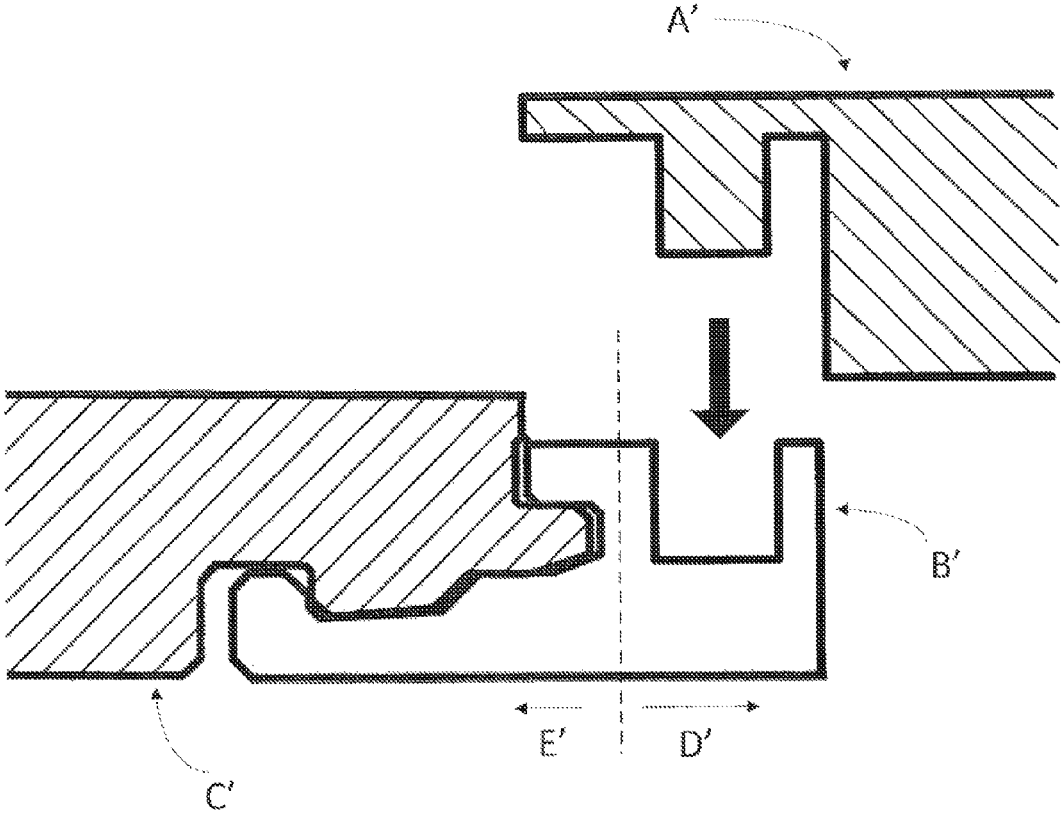
FIG. 3 depicts the invention on the tongue side of the existing flooring. A' depicts the new replacement panel of the invention that is to be added with one of its lateral faces designed to interlock vertically with a complementary structure on face D' of the adaptor B' of the invention. B' depicts the adaptor of the invention whose face E' connects horizontally to existing flooring panel C' and whose face D' mates vertically with new flooring panel A'. C' depicts a panel of the existing floor that presents a tongue face into the space vacated by the panel to be replaced.
Figure 4:
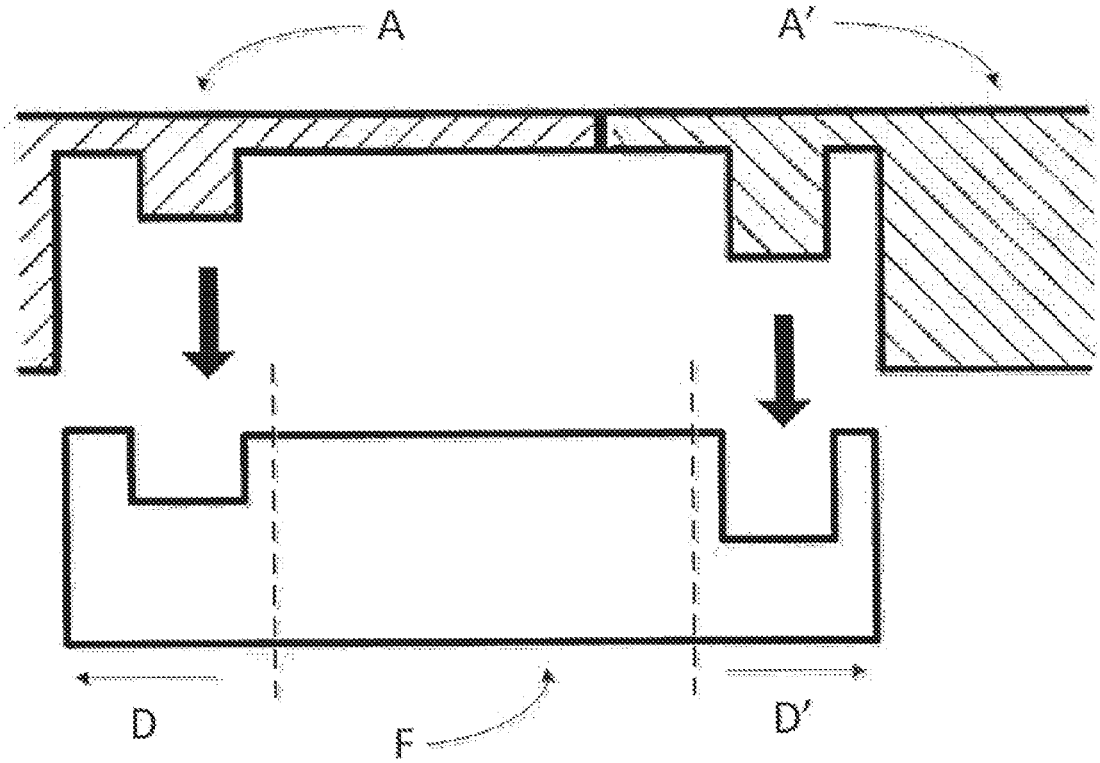
FIG. 4 depicts the coupling adaptor F of the invention which is used to join two contiguous replacement panels A and A'. D represents the face of the coupling adaptor that provides a vertical interlocking structure complementary to the structure of one edge of replacement panel A. D' represents the face of the coupling adaptor that provides a vertical interlocking structure complementary to the structure of one edge of replacement panel A'.

If there are two or more contiguous pieces that need replacement, an additional adaptor design is required. For instance, if two contiguous floor panels are damaged and require replacement, their removal creates an open space equivalent to the area of two floor panels. In order to introduce two replacement panels, adaptors as depicted in FIGS. 2 and 3 are required along the boundary edges of this space that interface with the existing floor panels. It is along these edges that 3 of the 4 edges of each new replacement panel will interface. However, a new coupling adaptor design is required along the center line of the open space where the $4^{th}$ floating edge of each new panel lies. Here, an adaptor design is required that binds these edges of the new panels together. Since there is no existing floor panel here, there is no need for the horizontal to vertical motion conversion. Rather, a coupling adaptor that provides vertical interlocking structures along its two edges which are complementary to the floating edges of the respective replacement panels is required. These interlocking structures are as depicted as faces D and D' in FIGS. 2, 3, and 4.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

What is claimed is:

1. A system for replacing a floor panel in a previously installed interlocked flooring comprised of a plurality of floor panels each having first interlock structure on one lateral edge and a differently configured second interlock structure on another latral edge, wherein a vacant space has been provided by the removal of a damaged floor panel to be replaced, said vacant space being bounded laterally by at least two adjacent panels of the installed flooring, said system comprising:

a) a first adaptor, configured to be inserted in the vacant space and interlocked with a first adjacent panel, wherein the first adaptor comprises:

i) an upper side, a lower side and at least two lateral faces;

ii) a first interlocking structure on one of said lateral faces configured to mate the first adaptor horizontally with a first interlock structure of the first adjacent panel; and iii) a second interlocking structure configured to mate vertically with a replacement floor panel; and b) a second adaptor, covfigured to be inserted in the vacant space and interlocked with a second adjacent panel, wherein the second adaptor comprises:

i) an upper side, a lower side and at least two lateral faces;

ii) a first interlocking structure on one of said lateral faces and configured to mate the second adaptor horizontally with a second interlock structure of the second adjacent panel; and iii) a second interlocking structure configured to mate vertically with a replacement floor panel; and c) a replacement floor panel arranged in the vacant space and configured to mate vertically with the second interlocking structure of each of said first and second adapter.

2. The system according to c1aim 1, wherein the interlocked flooring is selected from the group consisting of wooden, laminate, and vinyl based flooring.

3. The system according to claim 1, wherein the first interlocking structure of said first adaptor comprises a horizontal protrusion configured to extend horizontally into a mating horizontal groove in the first interlock structure of the first adjacent floor panel.

4. The system according to claim 1, wherein the second interlocking structure of each adaptor is located on the upper side of the respective adaptor.

5. The system according to the claim 4, wherein the second interlocking structure of each adaptor comprises at least one of notches and protrusion to mate vertically with complementary structure located on a bottom of the replacement floor panel.

6. The system according to the claim 1, wherein at least one of the horizontal and vertical mating of the interlocked flooring is strengthened by means of a material selected from the group consisting of adhesives, binding materials and and bonding materials.

7. The system according to claim 1, wherein the first interlocking structure of said second adaptor comprises at least one groove so as to receive horizontally at least one extended protrusion of the second adjacent floor panel.

8. A method for installing a replacement floor panel in a vacant space of an interlocked flooring, said method comprising the steps of;

(a) removing a damaged floor panel from the interlocked flooring without removing or damaging the floor panels adjacent thereto, thereby leaving a vacant space within the flooring;

(b) inserting at least two adaptors into the vacant space, wherein each adaptor comprises an upper side, a lower side and at least two lateral faces having an interlocking structure designed to mate horizontally with a corresponding interlock structure of an adjacent floor panel, the interlocking structure of one of said two adaptors being differently configured from the interlocking structure of the other of said two adapters;

(c) interlocking a lateral face of each adaptor horizontally with a separate floor panel adjacent to the vacant space; and (d) installing a replacement floor panel vertically downward onto the upper sided of the two adaptors, thereby interlocking with the adaptors, wherein the replacement floor panel is configured to mate vertically with the two adaptors such that the adjacent floor panels remain in place without moving.

9. The method according to claim 8, wherein method is carried out with the interlocked Flooring selected from the group consisting of wooden, laminate, and vinyl based flooring.

10. The method according to the claim 8, further comprising the step of strengthening at least one of the horizontal horizontal and vertical mating of the interlocked flooring by applying a material selected from the group consisting of adhesives, binding materials and bonding materials.

* * * * *